US005280887A

United States Patent [19]

Fontana

[11] Patent Number: 5,280,887

[45] Date of Patent: Jan. 25, 1994

[54] ELASTIC SUPPORT ELEMENT OR BELT FOR STUFFING OF FURNITURE PIECES OR CAR SEATS

[75] Inventor: Anacleto Fontana, Lesmo, Italy

[73] Assignee: Cintel S.r.l., Italy

[21] Appl. No.: 846,293

[22] Filed: Mar. 3, 1992

[30] Foreign Application Priority Data

Apr. 30, 1991 [EP] European Pat. Off. ..... 91830174.8

[51] Int. Cl.[5] ..... A47C 27/00; D04B 21/00

[52] U.S. Cl. ..... 267/142; 66/190

[58] Field of Search ..... 267/142, 146, 148; 428/230, 257, 258, 259; 66/190, 192, 202

[56] References Cited

U.S. PATENT DOCUMENTS

| | | | |
|---|---|---|---|
| 3,183,685 | 5/1965 | Riehl | 66/193 |
| 3,570,482 | 3/1971 | Emoto | 66/193 |
| 3,943,981 | 3/1976 | De Brabander | 428/92 |
| 4,248,064 | 2/1981 | Odham | 66/192 |
| 4,395,889 | 8/1983 | Schnegg | 66/190 |
| 4,631,932 | 12/1986 | Sommers | 66/192 |
| 4,677,831 | 7/1987 | Wunner | 66/190 |
| 4,787,219 | 11/1988 | Sato et al. | 66/190 |
| 4,802,346 | 2/1989 | Gajjar | 66/190 |

FOREIGN PATENT DOCUMENTS 2037828 12/1979 United Kingdom .

2104558 7/1982 United Kingdom .

*Primary Examiner*—Robert J. Oberleitner

*Assistant Examiner*—Chris Schwartz

*Attorney, Agent, or Firm*—Lerner, David, Littenberg, Krumholz & Mentlik

[57] ABSTRACT

The invention relates to an elastic belt for furniture articles or vehicle seats, wherein a plurality of weft yarns are interconnected by bonding yarns each with two elastic warp threads, preferably not adjacent warp threads. The weft yarns show longitudinal double S configurations allowing the weft to lengthen and shorten following the elastic warp threads. The invention further relates to a textile machine having elastic warp threads, a device for controlling the bonding yarns and a weft yarn guide with a plurality of passages for the plurality of weft yarns, the guide being acted upon to shift the weft yarns in both directions into alignment with two alternated warp threads, and to form the weft yarns double S configuration.

4 Claims, 3 Drawing Sheets

ELASTIC SUPPORT ELEMENT OR BELT FOR STUFFING OF FURNITURE PIECES OR CAR SEATS

BACKGROUND OF THE INVENTION

1. Field of the Invention

This invention relates to elastic supports for supporting stuffing or upholstery of seat or furniture pieces such as beds, divans, armchairs, chairs, car seats and the like, and more particularly to an improved elastic support element or belt of the type referred to and to a textile machine for weaving such elastic support or belt.

The use of elastic belts for supporting the stuffing or upholstery in furniture pieces such as seats, backs, arm rests, backboards, motorvehicle seats and backs, and the like is well known. The elastic belts of this kind at present in use are affected by various disadvantages such as for example a lack of uniform spring suspension because each belt applied to the supporting frame has not the same tension as the other belts which are stretched and applied one at a time, and therefore the more stretched belt "works" more than the other belts and supports alone all the weight of the user, thereby fringing and breaking prematurely and causing also the other belts to fringe and break. These elastic belts have been improved by providing on the elastic threads a spirally wound covering formed of natural or synthetic yarns.

From the Italian Patent No. 955 134 a support of this kind is also known, which comprises an elastic net formed of a net or honeycomb fabric made of rubber threads or the like arranged in the longitudinal or warp direction, which rubber threads are covered with a plurality of spirally wound yarns and preferably crossed in the other or weft direction by non-elastic threads of nylon or cotton or other suitable textile fiber.

However, also this support is affected by drawbacks due to the fact that the plurality of spirally wound yarns, while partially overcoming the drawback of the not-uniform spring suspension, require expensive working operations and the use of a great amount of textile yarn, which makes the spiral winding very expensive.

In an attempt to overcome this drawback, use was made of a yarn spirally wound in one direction and a yarn spirally wound in the opposite direction, but this has not solved the problems that the spiral winding involves.

Therefore the elastic threads covered by a plurality of spirally wound yarns, in spite of the precautions taken, lead to tension differences of the covered elastic threads at the time of their manufacture, what gives effect of false twistings and undulations of the elastic support element obtained thereby.

U.S. Pat. No. 4,728,565 improves the above mentioned support element by covering the rubber warp threads by loops formed chain-stitches, mainly improving the resistance and stability of the net.

However, even this last improvement did not reveal itself a perfect solution, because its continuous use brought to a relative shifting between the warp elastic threads and the weft yarn in given points, with a permanent and increasing alteration of the size ratios of at least some of the components of the net formed by said warp threads and weft yarn. This involves an improper reaction of the support belt or element and a reduced life thereof. To try to overcome this drawback, the support elements or belts were impregnated with a latex, but this gives a bad appearance to the product, reduces its resilient features, hinders the passage of air therethrough and rapidly ages the materials contacting the same, in particular the seat foam.

2. OBJECTS OF THE INVENTION

Accordingly, an object of the present invention is to provide a new elastic support element or belt particularly for the uses as above specified, having new connections between its net components, so to allow an elastic elongation of the element or belt even in specific zones thereof, without permanently modifying the net size ratios and in any case always ensuring a return to the original net configuration.

Another object of the invention is to provide a new elastic support element or belt as above stated having a long use life without the need of being impregnated with latex and without any problem of ageing the materials in contact with the same.

Further objects of this invention are to provide a new elastic support element or belt, of the type referred to, having a particularly good "anatomic behavouir" and good characteristics of vibration and noise dampening, as well as so manufactured in such a way that it can be cut, sewn and so on, without risk to impair its properties or unravel its net as used herein, the term "anatomic behavior" means that the present elastic support element has a sufficient degree of flexibility to conform to the contours of the human body when a person sits on a seat including such support element.

Another object of the invention is to provide a textile machine so improved to be able to weave a support elastic element or belt of the type as above disclosed, and in which the width of the belt can be choosen at will, with the possibility of simultaneously weaving two or more belts, if the machine width allows it.

SUMMARY OF THE INVENTION

Accordingly, this invention mainly relates to an elastic support element for supporting the stuffing or upholstery in car seats or furniture pieces, of the type formed by a longitudinally elastic belt made of a fabric comprising a plurality of elastic warp threads, a crossing non-elastic weft and a plurality of bonding yarns, each of which bonds one elastic warp thread at its crossing points with the weft, characterized in that a plurality of non-elastic weft yarns are provided for and connected with said plurality of elastic warp threads by means of said bonding yarns, each weft yarn being bonded with at least two elastic warp threads at the sides of a zig-zag path of said weft yarn.

Further features of the elastic support element or belt of the invention are specified in claims 2 to 6. According to another aspect of the present invention, it relates to a textile machine for manufacturing an elastic support element or belt as above stated, of the type comprising means to place and advance a number of elastic warp threads, means for alternately moving in a direction perpendicular to said warp threads a non-elastic weft, and means for bonding said warp threads and weft by means of stitches formed by one bonding yarn acting on each warp thread, characterized in that it comprises a weft yarn guide having a plurality of passages for placing and guiding a plurality of weft yarns, said weft yarn guide being alternatively moved in both directions perpendicularly to the warp threads by a distance at least equal to that between two adjacent warps threads.

The above and further features of the present invention will be better described by way of example only with reference to the accompanying diagrammatic drawings, wherein:

DESCRIPTION OF THE PREFERRED EMBODIMENTS

Figure 1:
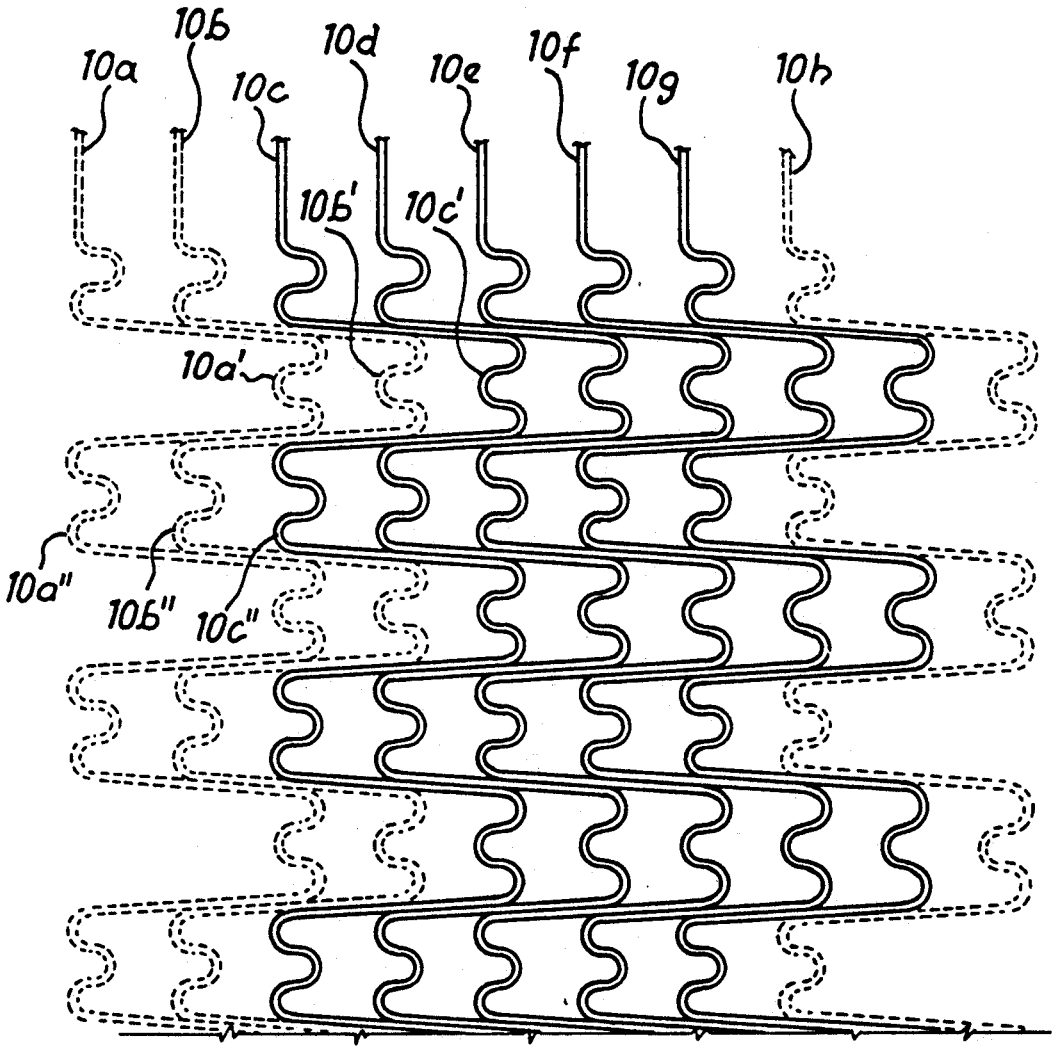
FIG. 1 is a magnified view of the weft yarn paths in a portion of an elastic element or belt according to the invention.

Referring firstly to FIG. 1, the elastic support element or belt according to the invention, instead of having one weft yarn only, orthogonally crossing in both directions the warp elastic threads as in U.S. Pat. No. 4,728,565, has a plurality of weft yarns, preferably non-elastic textile fibers as nylon, cotton or the like. The weft yarns 10a–10h are in a number equal to that of the elastic warp threads (as will be seen later on) and each of them orthogonally crosses the warp threads in both directions by a length equal to two steps, i.e. to the distance between three adjacent warp threads. In other words, assuming that each weft yarn 10a–10h is originally placed in correspondence with one warp thread (upper part of FIG. 1), all weft yarns 10a–10h are shifted toward the right in FIG. 1 by a length so that the yarn 10a reaches a point 10a' aligned with the original position of yarn 10c, the yarn 10b a point 10b' aligned with the position of yarn 10d, the yarn 10c a point 10c' aligned with 10e and so on. Thereafter, all yarns 10a–10h are shifted toward the left in FIG. 1 to reach points 10a'', 10b'', 10c'' . . . newly aligned with the original positions.

Note that in the drawings the lines representing the weft yarns between points 10a, 10a', 10a'' . . . , 10b, 10b', 10b'' . . . and so on, are shown slightly slanting on the horizontal for clarity of the drawing, but the yarn lengths are actually orthogonal to the warp direction, coinciding with the longitudinal direction of the drawing. In correspondence to points 10a', 10a'' . . . , 10b', 10b'' . . . , 10c', 10c'' . . . the weft yarns show a double S configuration, with a limited extension in the transversal or width direction and with an extension in the warp direction depending on the desired size of the net squares in this direction and of their lengthening desired ability. This configuration, as well shown in the drawings, allows to simultaneously reach two results, i.e. to obtain a good bond with the warp threads, as it will be seen with reference to FIG. 2, and to allow for a lengthening and a shortening of the final net in the longitudinal or warp direction, without stressing the non-elastic weft yarns 10a–10h.

Figure 2:
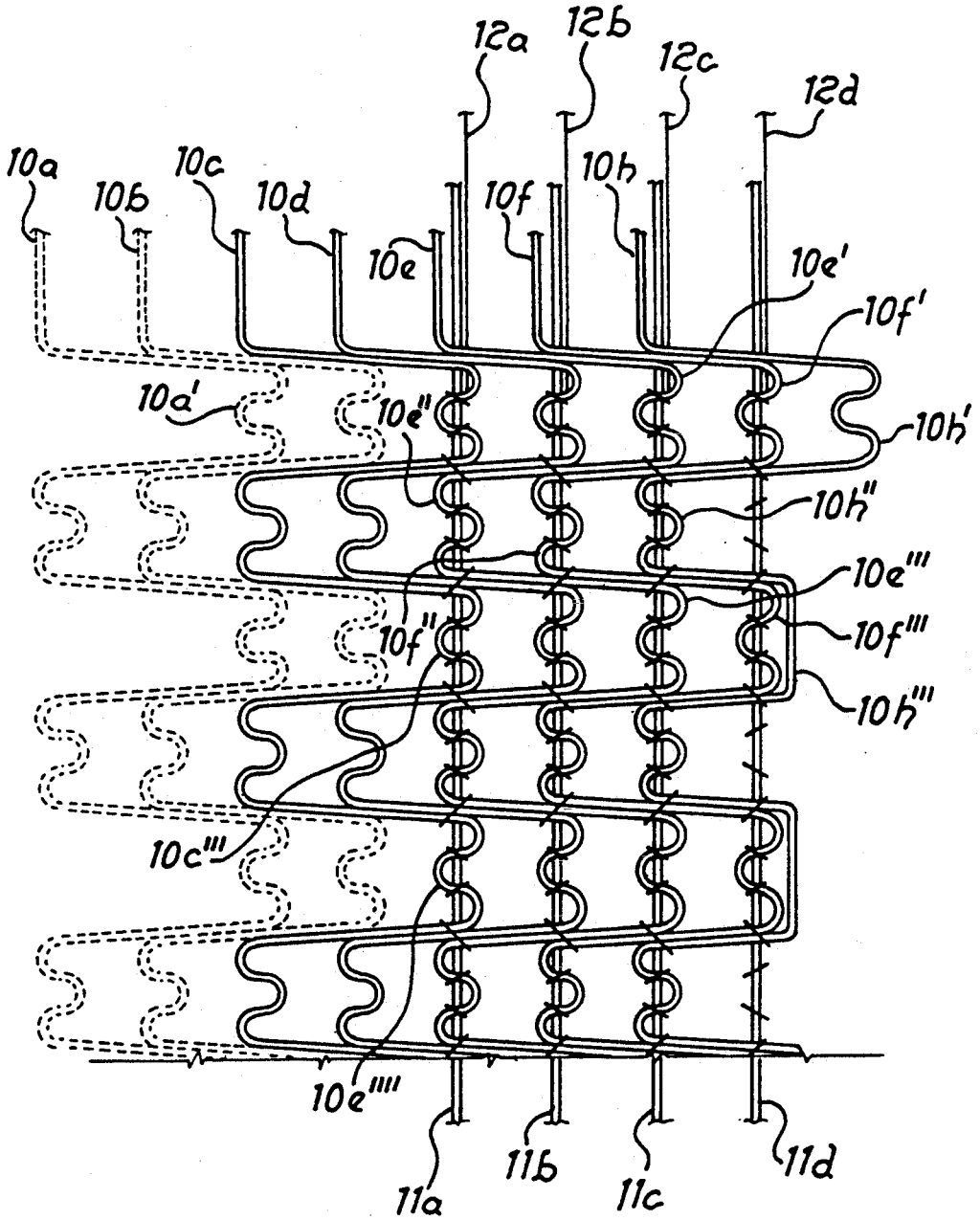
FIG. 2 is a magnified view according to that of FIG. 1, wherein some of the warp threads and related bonding yarns are shown in correspondence with one side of the elastic element or belt.

With reference to FIG. 2, the warp threads 11a–11d are also shown. Said warp threads, which are elastic threads, preferably but not necessarily of rubber, are placed each in correspondence with one weft yarn, but shifted by one step, so that at the sides of the elastic element or belt a weft yarn is missing (right side in FIG. 2) or a warp thread is missing (left side in FIG. 2-not shown). At the right side as shown in FIG. 2, no weft yarn is provided for in correspondence with the last warp thread 11d. The term "correspondence" as used in this paragraph, refers to a one-to-one relationship between the weft yarns and respective warp threads. For example, weft yarn 10e is in "correspondence" with warp thread 11a, weft yarn 10f is in correspondence with warp thread 11b, etc.

Each warp thread (with the exception of the belt side ones) is bonded to two weft yarns, having double S configurations in correspondence with the same, by means of a thin binding yarn, for instance a nylon, or other synthetic yarnS 12a–12d, one for each elastic warp thread. Said bonding yarns 12 are interconnected with both warp thread 11 and weft yarn 10 preferably by loops made of chain stitches. Referring to FIG. 2, for instance the elastic warp thread 11a is bonded by bonding yarn 12a in correspondence to points 10c' to weft yarn 10c, 10e'' to weft yarn 10e, 10c''' to weft yarn 10c, and so on. The last warp thread 11d is bonded only at points 10f', 10f''' . . . , with the weft yarn 10f, while the remaining portions of the warp thread 11d are simply covered by chain stitches of yarn 12d. At the other belt side, the same happens with the last warp thread.

The last double S formation as shown at point 10h' in FIG. 2 is not bonded to a warp thread and remains free, assuming the configuration as shown with 10h''' in the same FIG. 2, to form the selvage. The same happens at the other belt side.

Figure 3:
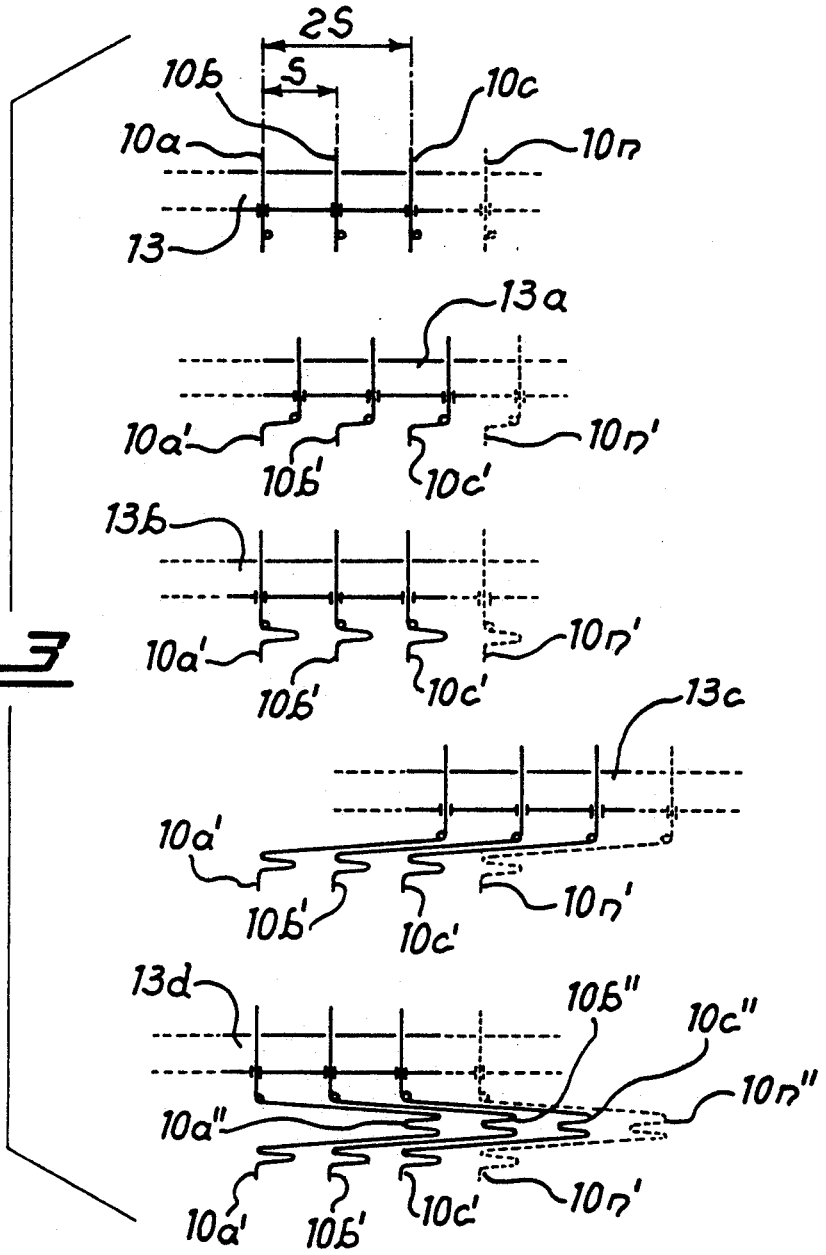
FIG. 3 is a diagrammatic scheme of the movements of the weft yarn guide in a textile machine as improved to weave the elastic element or belt of FIG. 2.

In order to weave an elastic element or belt according to what above stated, the invention comprises a textile machine, as known per-se, comprising means for feeding a plurality of elastic warp threads (not shown in FIG. 3 but longitudinally placed at a reciprocal constant distance of one step S), means for feeding an identical plurality of bonding yarns and for interlacing, preferably by chain stitches, said bonding yarns, each with one corresponding warp thread and with one or more weft yarns.

According to the invention, the textile machine has a weft drive or guide element 13 with a plurality of passages for weft yarns 10a–10h preferably in a number equal to that of the warp threads. Starting from a first position, said weft yarn guide 13 is initially moved to and fro by reduced amounts, as shown with 13a and 13b in FIG. 3, in order to create the double S configuration 10a'–10h' as shown in the same FIG. 3. Thereafter, said weft guide 13 is controlled to carry-out a movement f.i. toward the right in FIG. 3 by an amount corresponding to two steps, 2S, as shown in 3c, where further movements of reduced amounts form further double S configurations 10a'', 10b'', 10c''. . . 10h'', before a returning motion of two steps 2S to newly bring the weft guide to its original position as shown in 13d.

Figure 4:
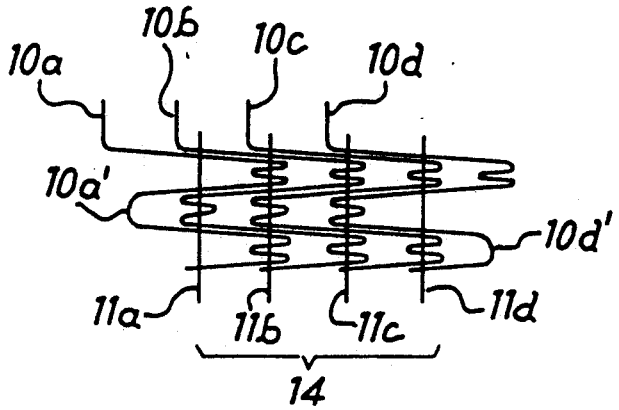
FIG. 4 diagrammatically shows the position of the warp threads and weft yarns at the sides of an elastic belt according to the invention.

It is to be pointed out that the width of the textile machine is by no means bonding as to the width of the manufactured belt, with the sole obvious limitation that the belt must have a width equal or lesser than that of the machine. In order to define the width of the belt, it is sufficient, in said textile machine, to remove one elastic warp thread for each side of the belt, and the corresponding weft yarn, as well as the immediately inner weft yarn on one belt side. It is then obtained a situation of the type as shown in FIG. 4, where a belt 14 with only four warp threads 11a–11d is shown. An equal number of weft yarns 10a–10d are foreseen, shifted by one step S with reference to the warp threads. It is to be noted that the side warp threads 11a and 11d are bonded with one weft yarn only, 10*b* and 10*c* respectively, and that the side weft yarns 10*a* and 10*d* form, with their outer double S configuration, successively stretched, the outer curves 10*a'* and 10*d'* of the selvage. It is then possible to weave simultaneously with the same machine more than one belt, of course if the sizes of the belts and of the machine allow it.

It is to be finally pointed-out that the invention can be carried-out also by bonding each weft yarn with two adjacent elastic warp threads. In this case the weft yarns must be in a number equal to that of the warp threads plus one. The net obtained in this case has squares more closed than the preceding one and a higher yarn amount is necessary.

I claim:

1. An elastic support element for use in car seats or furniture comprising:

a plurality of elastic warp threads arranged parallel to each other in a first plane extending in a longitudinal direction, wherein a predetermined distance exists between adjacent ones of said plurality of warp threads;

a plurality of non-elastic weft yarns extending partially along said longitudinal direction and extending partially along a weft direction generally transverse to said longitudinal direction, said weft yarns defining a zig-zag path and being connected to at least every other one of said warp threads at predetermined crossing points arranged on respective every other one of said plurality of warp threads, said weft yarns being shifted in said weft direction at said predetermined crossing points by a distance corresponding to two of said predetermined distances between adjacent ones of said plurality of warp threads; and a plurality of bonding yarns connecting said weft yarns to respective ones of said at least every other warp thread at said predetermined crossing points.

2. The elastic support element of claim 1 wherein the number of said weft yarns is equivalent to the number of warp said threads.

3. The elastic support element of claim 1 wherein said bonding yarns form loops of chain stitches on respective ones of said warp threads.

4. The elastic support element of claim 1 wherein said zig-zag path of said weft yarns defines a first side and a second side, each of said weft yarns having a double s-shaped fold at said first and second sides thereof, said double s-shaped folds extending generally along said longitudinal direction and corresponding to a respective one of said warp threads to which a respective one of said weft yarns is bonded.

* * * * *